US008191676B2

(12) United States Patent
Havener et al.

(10) Patent No.: US 8,191,676 B2
(45) Date of Patent: Jun. 5, 2012

(54) RESONATOR FOR A DUAL-FLOW EXHAUST SYSTEM

(75) Inventors: Kerry Timothy Havener, Canton, MI (US); Timothy F. Kilroy, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 12/939,737

(22) Filed: Nov. 4, 2010

(65) Prior Publication Data

US 2012/0111663 A1 May 10, 2012

(51) Int. Cl.

| | |
|---|---|
| ***F01N 1/08*** | (2006.01) |
| ***F01N 1/02*** | (2006.01) |
| ***F01N 13/04*** | (2010.01) |
| *F01N 1/00* | (2006.01) |
| *F01N 13/00* | (2010.01) |

(52) U.S. Cl. ..... 181/272; 181/238; 181/239; 181/249; 181/251; 181/255

(58) Field of Classification Search ..... 181/272, 181/275, 281, 268, 269, 238, 239, 249, 251, 181/255, 248, 247

See application file for complete search history.

(56) References Cited

U.S. PATENT DOCUMENTS

| | | | | |
|---|---|---|---|---|
| 1,087,468 | A * | 2/1914 | Steinmetz | 181/269 |
| 2,343,152 | A * | 2/1944 | Marx | 181/249 |
| 2,356,782 | A * | 8/1944 | Muller | 181/238 |
| 2,370,259 | A * | 2/1945 | Rippingille | 60/313 |
| 2,573,474 | A * | 10/1951 | Marx | 184/47 |
| 2,614,647 | A * | 10/1952 | Bryant | 181/269 |
| 2,928,492 | A * | 3/1960 | Nelson | 181/275 |
| 3,090,464 | A * | 5/1963 | Deremer | 181/238 |
| 3,388,769 | A * | 6/1968 | Martoia | 181/238 |
| 3,794,139 | A * | 2/1974 | Hetherington et al. | 181/238 |
| 4,213,414 | A * | 7/1980 | Sato et al. | 440/89 R |
| 4,360,076 | A * | 11/1982 | Suyama | 181/265 |
| 4,381,832 | A | 5/1983 | Rauch | |
| 4,408,675 | A | 10/1983 | Keller | |
| 4,523,662 | A * | 6/1985 | Tanaka et al. | 181/249 |
| 4,911,262 | A | 3/1990 | Tani et al. | |
| 4,934,141 | A | 6/1990 | Ollivon et al. | |
| 5,025,890 | A * | 6/1991 | Hisashige et al. | 181/272 |
| 5,168,132 | A | 12/1992 | Beidl et al. | |
| 5,388,408 | A | 2/1995 | Lawrence | |
| 5,519,994 | A * | 5/1996 | Hill | 60/313 |
| 5,979,583 | A * | 11/1999 | Amino et al. | 180/219 |
| 6,467,572 | B1 * | 10/2002 | Liu | 181/272 |
| 6,752,240 | B1 * | 6/2004 | Schlagenhaft | 181/249 |

(Continued)

FOREIGN PATENT DOCUMENTS

DE 3807948 A1 * 9/1989

*Primary Examiner* — Edgardo San Martin

(74) *Attorney, Agent, or Firm* — Allan J. Lippa; Alleman Hall McCoy Russell & Tuttle LLP

(57) ABSTRACT

A resonator for a dual-flow exhaust system of an engine is provided. The resonator includes a housing defining an enclosure and a baffle spanning the housing and separating a first and second expansion chamber of the enclosure, the baffle including at least one opening. The resonator further includes a first and a second exhaust conduit extending through the baffle and housing, each conduit in fluidic communication with a separate cylinder bank and including a perforated portion fluidly coupled to the enclosure, each perforated portion positioned in separate expansion chambers.

14 Claims, 4 Drawing Sheets

U.S. PATENT DOCUMENTS 6,912,843 B2 * 7/2005 Hufendiek et al. ..... 60/282
7,377,359 B2 * 5/2008 Hofmann et al. ..... 181/275
7,562,741 B2 * 7/2009 Winklel et al. ..... 181/239
2004/0262077 A1 12/2004 Huff et al.
2005/0224283 A1 * 10/2005 Yokoi et al. ..... 181/268
2006/0037814 A1 * 2/2006 Mabuchi et al. ..... 181/272
2009/0301807 A1 12/2009 Uhlemann et al.

* cited by examiner

RESONATOR FOR A DUAL-FLOW EXHAUST SYSTEM

BACKGROUND/SUMMARY

Dual-flow exhaust systems having two exhaust conduits directing exhaust gases away from an internal combustion engine may be used in a variety of engines. It may be particularly beneficial to use a dual-flow exhaust system in an engine having a V cylinder configuration, due to the layout and packaging of the engine components. The benefits include increased engine compactness and improved engine performance.

Acoustic attenuation devices, such as resonators and mufflers, have been designed to reduce and in some cases eliminate acoustic frequencies in dual-flow exhaust streams. Exhaust systems employing a pair of resonators have been designed to attenuate acoustic frequencies present in dual-flow exhausts. For example, in U.S. Pat. No. 4,408,675 an exhaust system with a resonator coupled to each exhaust stream is disclosed. However, there may be several shortcomings with this type of design. The cost of the vehicle may be increased when multiple resonators are utilized as opposed to a single resonator. Furthermore the size of the exhaust system may be increased when multiple resonators are utilized.

Attempts have been made to use a single resonator to attenuate acoustic frequencies in both exhaust streams of dual-flow exhaust systems. For example a resonator having two exhaust conduits communicating through two horizontally opposed opening that are fluidly coupled to a neck is disclosed US 2009/0301807. Exhaust gases may flow into the sealed resonator enclosure (i.e., neck-body) from either exhaust conduit via the horizontally opposed opening. In turn, sound waves are transferred to the resonator of which a portion are reflected off the walls of the housing and neck body and attenuated.

The inventors have recognized several issues with the exhaust system disclosed in US 2009/0301807. For example, the configuration of the disclosed resonator, in particular the positioning of the opening, increases back pressure in the exhaust stream degrading engine efficiency. Moreover, a limited range of frequencies may be attenuated due to the spatial constraints of the neck body. Other dual-flow single enclosure resonator designs also involve trade-offs between the amount of acoustic attenuation provided by the resonator and back-pressure generated by the device.

As such, various example systems and approaches are described herein. For example, a resonator for a dual-flow exhaust system of an engine is provided. The resonator includes a housing defining an enclosure and a baffle spanning the housing and separating a first and a second expansion chamber of the enclosure, the baffle including at least one opening. The resonator further includes a first and a second exhaust conduit extending through the baffle and housing, each conduit in fluidic communication with a separate cylinder bank and including a perforated portion fluidly coupled to the enclosure, each perforated portion positioned in separate expansion chambers.

It will be appreciated that the opening in the baffle enables fluidic communication between the first and second expansion chambers to attenuate a targeted frequency or frequency range without unduly increasing the back pressure. The opening may increase frequency attenuation when compared to resonators designed without an opening. It will be appreciated that the size of the opening may be independently tuned to attenuate a desired frequency or frequency range without increasing losses within the exhaust system.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

A resonator for a dual-flow exhaust system of an engine is provided. The resonator includes a housing defining an enclosure and a baffle spanning the housing and separating a first and second expansion chamber of the enclosure. The resonator further includes a first and a second exhaust conduit extending through the baffle including at least one opening and housing, each conduit in fluidic communication with a separate cylinder bank and including a perforated portion fluidly coupled to the enclosure, each perforated portion positioned in separate expansion chambers. Additionally the baffle may include one or more openings fluidly coupling the first and second expansion chambers. It will be appreciated that the opening(s) enables a greater amount of acoustic attenuation in the resonator without unduly increasing the back pressure in the exhaust system. It will be appreciated that the size of the opening(s) may be adjusted to at least partially attenuate a desired frequency or frequency range without substantially affecting the back-pressure generated by the resonator. Additionally, it will be appreciated that the positioning of the perforated portions of the conduits in separate chambers enables cross-talk between the conduits to be reduced, thereby reducing back-pressure.

Figure 1:
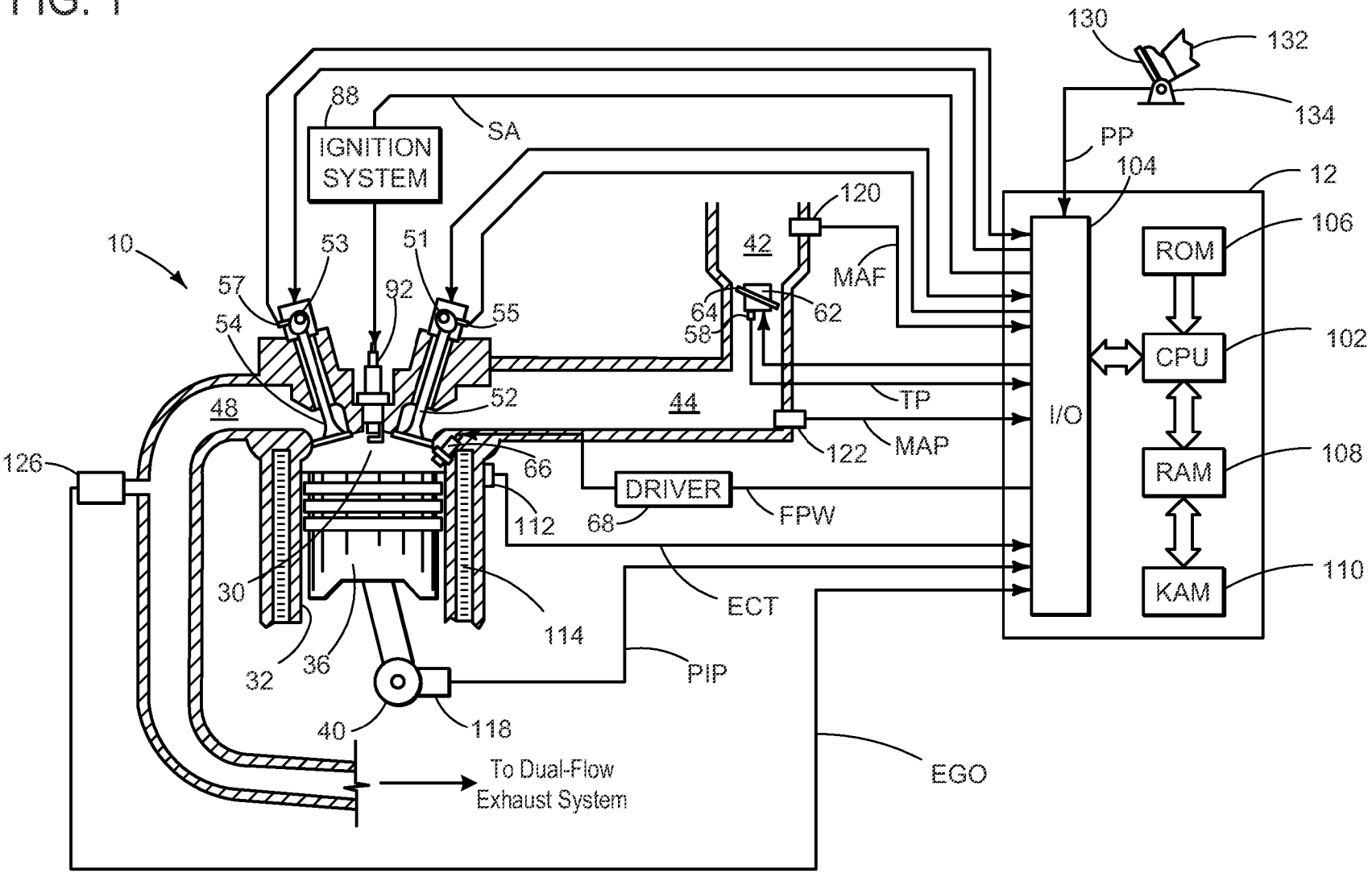
FIG. 1 shows a schematic depiction of an internal combustion engine.
Figure 2:
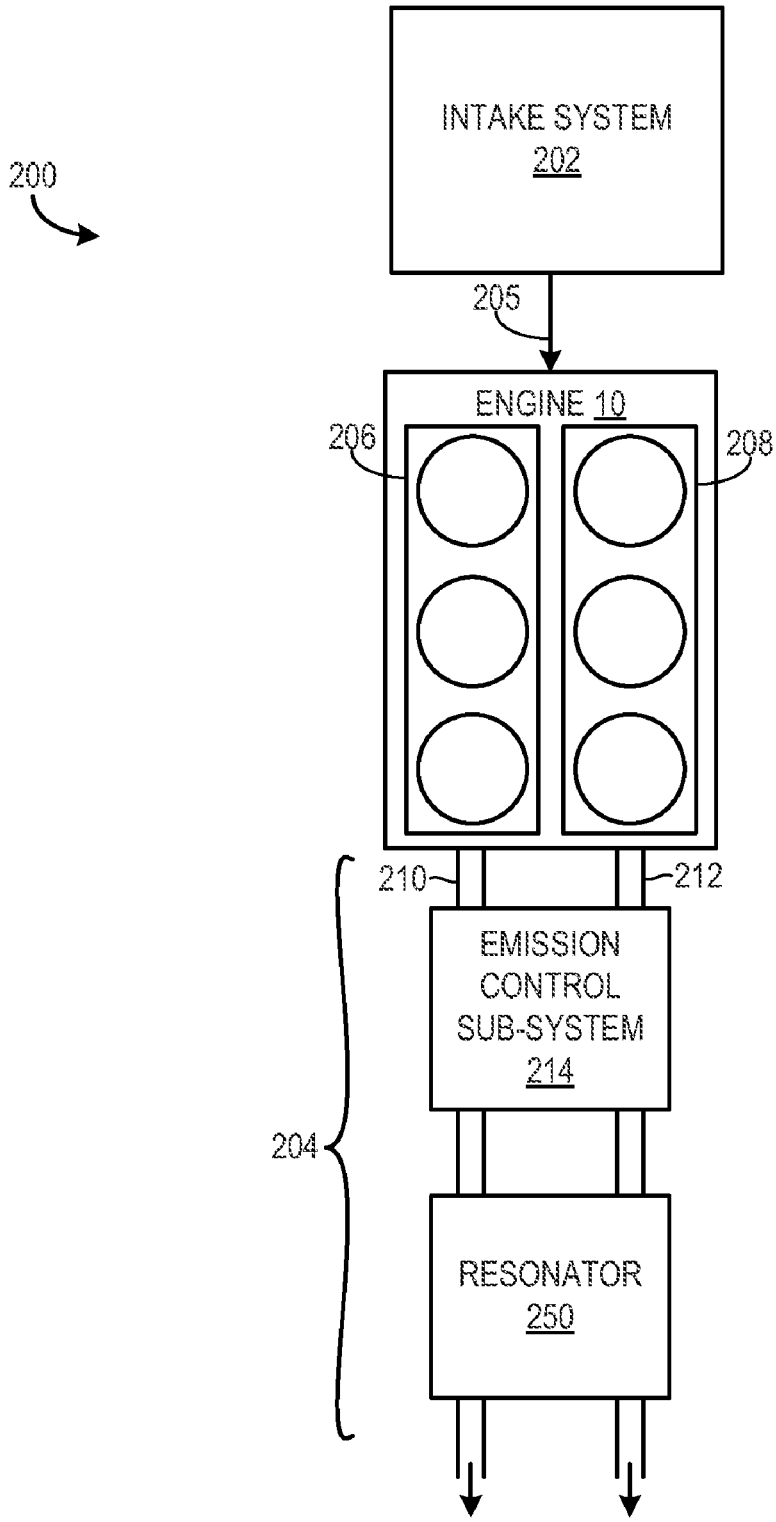
FIG. 2 shows a schematic depiction of a vehicle including an intake system, the engine shown in FIG. 1, and a dual-flow exhaust system.
Figure 3:
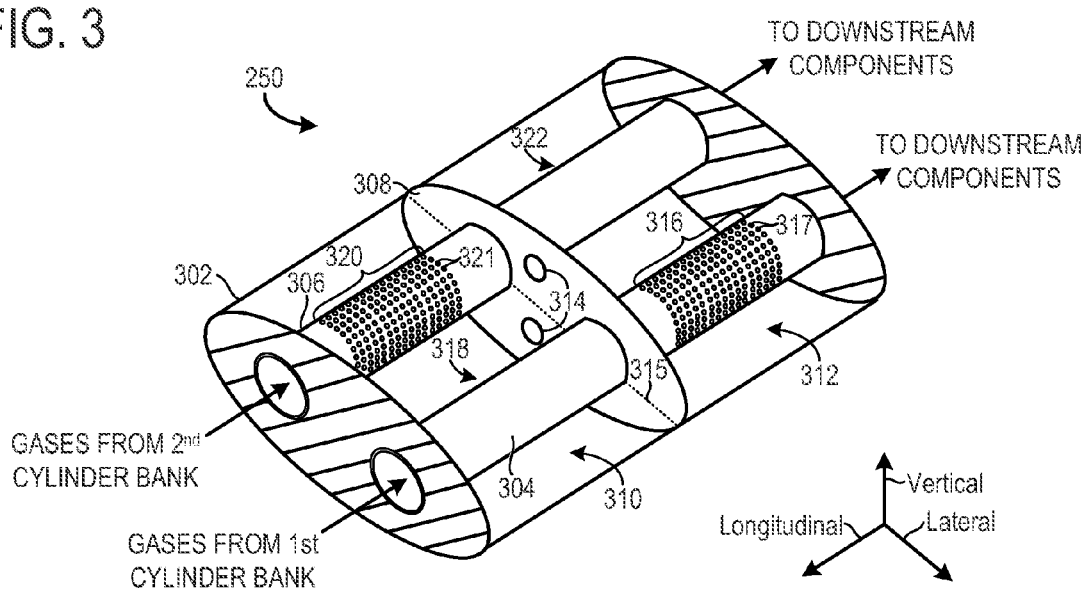
FIG. 3 shows an illustration of an embodiment of the resonator included in the dual-flow exhaust system shown in FIG. 2.
Figure 5:
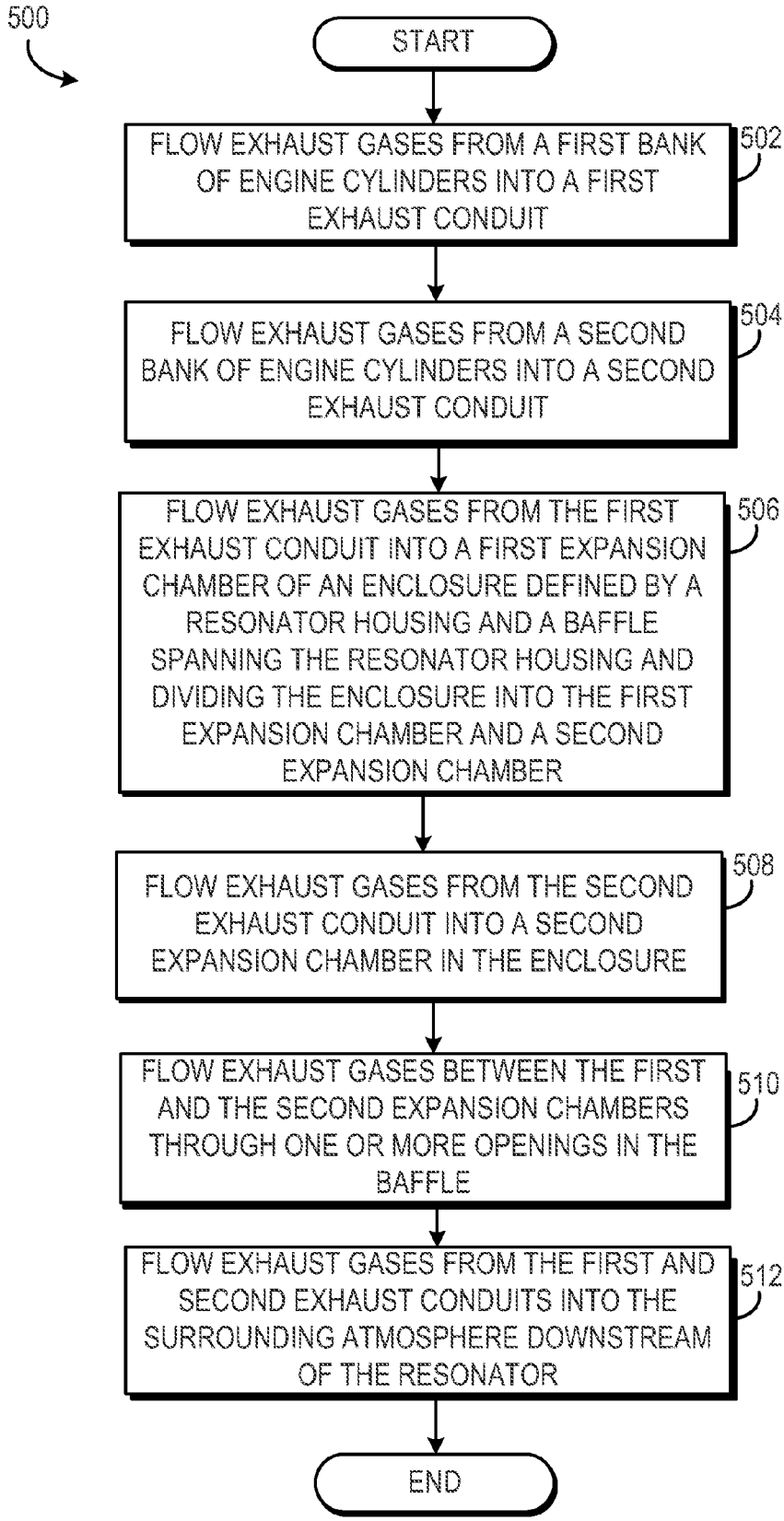
FIG. 5 shows a method for operation of a dual-flow exhaust system in which a resonator is utilized to attenuate targeted frequencies.

In this way, targeted frequencies (e.g., frequency ranges) may be at least partially attenuated for both of the exhaust streams via a single enclosure, thereby reducing the manufacturing cost of the resonator. Moreover the repair and replacement cost of the resonator may be reduced when a single enclosure design is employed when compared to a design that utilizes a resonator enclosure for each exhaust stream. FIG. 1 shows a schematic depiction of an engine. FIG. 2 shows a schematic depiction of a vehicle including an intake system and a dual-flow exhaust system coupled to the engine shown in FIG. 1. FIG. 3 shows an example resonator that may be included in the dual-flow exhaust system shown in FIG. 2. FIG. 5 shows a method for operation of an exhaust system.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Intake manifold 44 is also shown intermediate of intake valve 52 and air intake zip tube 42. Fuel is delivered to fuel injector 66 by a fuel system (not shown) including a fuel tank, fuel pump, and fuel rail (not shown). The engine 10 of FIG. 1 is configured such that the fuel is injected directly into the engine cylinder, which is known to those skilled in the art as direct injection. Fuel injector 66 is supplied operating current from driver 68 which responds to controller 12. In addition, intake manifold 44 is shown communicating with optional electronic throttle 62 with throttle plate 64. In one example, a low pressure direct injection system may be used, where fuel pressure can be raised to approximately 20-30 bar. Alternatively, a high pressure, dual stage, fuel system may be used to generate higher fuel pressures. Additionally or alternatively fuel may be injected upstream of intake valve 52 via a fuel injector (not shown), which is known to those skilled in the art as port injection.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48. Alternatively, a two-state exhaust gas oxygen sensor may be substituted for UEGO sensor 126.

Various components such as a convertor, acoustic attenuation devices (e.g., resonator, muffler), etc., may be in fluidic communication with exhaust manifold 48. The convertor and acoustic attenuation devices may be included in a dual-flow exhaust system. Therefore, it will be appreciated that engine 10 may include a second exhaust manifold coupled to another combustion chamber. The dual-flow exhaust system is discussed in greater detail herein with regard to FIG. 2.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

FIG. 2 shows a schematic depiction of vehicle 200 including engine 10, intake system 202, and dual-flow exhaust system 204. It will be understood that a dual-flow exhaust system includes two fluidically separated exhaust conduits for directing exhaust gases away from an engine. As discussed above with regard to FIG. 1 the intake system may include a throttle 62, intake manifold 44, etc. Arrow 205 indicates the flow of air and/or other intake gases into the engine. Thus, the intake system is configured to provide air to the engine for combustion. It will be appreciated that additional systems may be included in vehicle 200 which are not depicted in FIG. 2. For example, an exhaust gas recirculation (EGR) system and/or boosting system (e.g., supercharger, turbocharger) may be provided in other embodiments.

As shown, the engine includes six cylinders. However it will be appreciated that the engine may include an alternate number of cylinders in other embodiments. The cylinders are divided into a first cylinder bank 206 and a second cylinder bank 208. Furthermore, the cylinder may be in a V type of configuration, in which the central axes of each opposing cylinder intersect at a non-straight angle. However, other cylinder configurations may be utilized in other embodiments, such as a flat or inline cylinder configuration. The engine's displacement may be 3.7 liters. However, other displacements may be used. The cylinders included in both of the cylinder banks may be coupled to a dual-flow exhaust system 204. The dual-flow exhaust system includes a first exhaust conduit 210 coupled to the first cylinder bank 206. Specifically, the first exhaust conduit includes an input exclusively coupled to the first cylinder bank. Likewise a second exhaust conduit 212 is coupled to the second cylinder bank 208 and included in the dual-flow exhaust system. Specifically, the second exhaust conduit includes an input exclusively coupled to the second cylinder bank. The dual-flow exhaust system may further include an emission control sub-system 214 coupled to the first and second exhaust conduits. The emission control sub-system may include one or more emission control devices, such as particulate filters, convertors, etc. In one example, the emission control system may include a convertor including multiple catalyst bricks. In another example, multiple emission control devices, each with multiple bricks, can be used. It will be appreciated that exhaust conduits (i.e., the first and second exhaust conduits 212 and 214) may be fluidically separated in emission control sub-system 214. In other words, mixing of the exhaust gases from the first and second exhaust conduits may be inhibited in the emission control sub-system to maintain separated exhaust streams. Additional components such as a muffler may also be included in the dual-flow exhaust system upstream or downstream of a resonator 250.

As discussed above combustion may be implemented via intake and exhaust valve actuation. Consequently, pulses of high pressure exhaust gases are generated in the exhaust stream, thereby generating sound waves propagating downstream in the dual-flow exhaust system. It will be appreciated that the frequency and amplitude of the sound waves generated in the exhaust streams may depend upon the valve timing, fuel injection timing, engine speed, engine displacement, etc. It may be desirable to decrease and in some cases eliminate at least a portion of the sound waves generated in the engine and propagated through the dual-flow exhaust system to reduce noise pollution generated by the vehicle and provide the driver with a more agreeable driving experience. Therefore, resonator 250 may also be included in the dual-flow exhaust system. The resonator may be configured to attenuate a desired audible frequency or range of audible frequencies within the exhaust system via destructive interference within an enclosure of the resonator. In this way, noises generated via the engine may be reduced. The resonator may be positioned in the exhaust stream 94 inches from the exhaust valves in the first cylinder bank and 87 inches from the exhaust valves in the second cylinder bank. However, in other examples other positions are possible.

Figure 4:
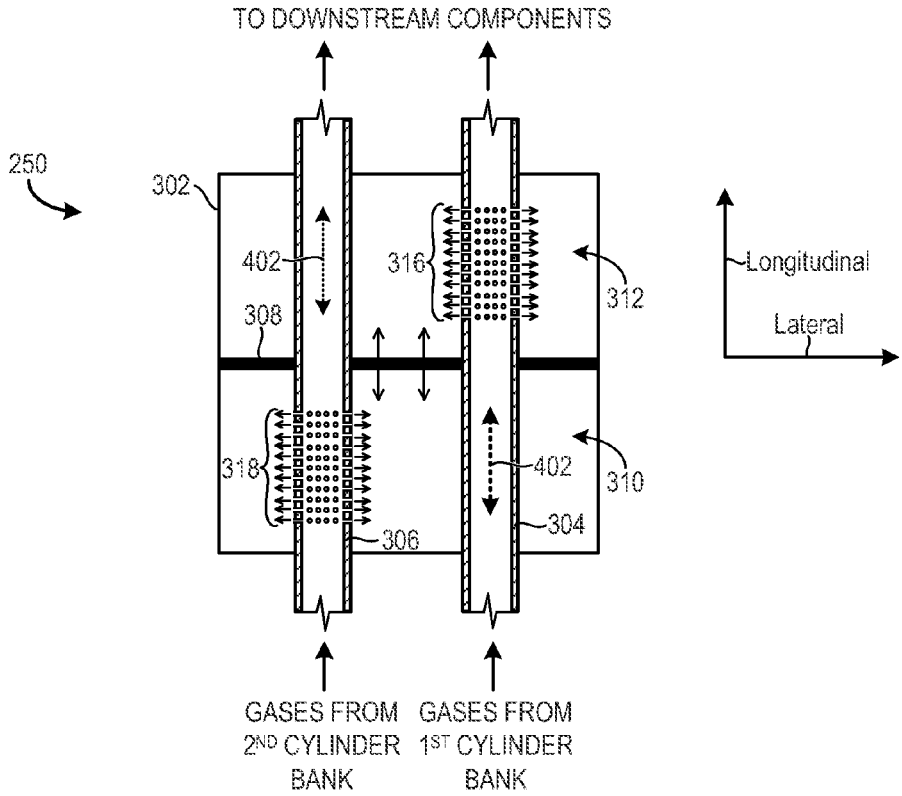
FIG. 4 shows a cross-sectional view of the resonator shown in FIG. 3.

FIG. 3 shows an example resonator 250. The resonator may include a housing 302 defining an enclosure. A portion of the housing has been removed to reveal the components contained within. However, it will be appreciated that the enclosure may be substantially sealed from the surrounding environment (i.e., isolated from the ambient air pressure). The resonator may include a portion 304 of the first exhaust conduit 210 shown in FIG. 2 as well as a portion 306 of the second exhaust conduit 212 shown in FIG. 2. Portions 304 and 306 extend through the enclosure. As depicted, the central axes 402 of the first and second exhaust conduits, shown in FIG. 4, are substantially parallel. However in other examples, other conduit orientations are possible. Moreover, the diameter of each of the portions 304 and 306 extending through the housing may be substantially equal.

Returning to FIG. 3, the resonator may further include a baffle 308 dividing the enclosure into a first and a second expansion chamber, 310 and 312 respectively. As shown the front and rear surfaces of the baffle are substantially flat. However, in other examples, one or more of the surfaces may be curved. The first expansion chamber is positioned upstream of the second expansion chamber. However, in other examples, the baffle may extend lengthwise in the enclosure. Specifically in some examples, the baffle may be parallel to the central axes first and/or second exhaust conduits.

The baffle may include one or more openings 314 fluidly coupling the first expansion chamber to the second expansion chamber. In some examples, the openings 314 may be offset with respect to a lateral axis 315 perpendicular to the central axis of the first or second exhaust conduits. Additionally, the openings 314 may also be offset with respect to a vertical axis. When the openings are positioned in this way the structural integrity of the resonator is increased and the cost of manufacturing is reduced.

Additionally, the first exhaust conduit may include a perforated portion 316 having a plurality of perforations 317 extending through the first exhaust conduit, fluidly coupling the first exhaust conduit to the second expansion chamber. Additionally, the first exhaust conduit includes a non-perforated portion 318. Likewise the second exhaust conduit may include a perforated portion 320 having a plurality of perforations 321 extending through the second exhaust conduit, fluidly coupling the second exhaust conduit to the first expansion chamber. Additionally, the second exhaust conduit includes a non-perforated portion 322. The perforated portions are positioned in opposing expansion chambers. Thus, the perforated portion of the first exhaust conduit may be positioned in the second expansion chamber and the perforated portion of the second exhaust conduit may be positioned in the first expansion chamber or visa-versa.

The size, number, and spacing of the perforations in both of the exhaust conduits may be identical. However, in other examples the perforated portion 316 of the first exhaust conduit may include a varying number of perforations, differently sized perforations, and/or differently spaced perforations than the perforated portion 320 of the second exhaust conduit. Specifically in some examples, the perforations in the first exhaust conduit may be asymmetric and the perforations in the second exhaust conduit may be symmetric. Further in other examples, the perforations in the first exhaust conduit may be larger than the perforations in the second exhaust conduit. Still further, there may be a greater number of perforations in the first exhaust conduit than the second exhaust conduit.

Moreover, the perforations may extend radially around each portion of the first and/or second exhaust conduits. In other words, perforations may extend a full 360 degrees around the portion of the exhaust conduits enclosed in the resonator housing. In other words the perforations may extend around the entire circumference of the first and/or second exhaust conduit. However, in other embodiments, the perforations may only partially extend radially around the exhaust conduits. In some examples the perforations may extend between 45°-180° around one or both of the conduits. In such an example, the perforations may face the outer wall of the housing or may face the center of the enclosure to direct the sound wave in a direction that is conducive to attenuating the targeted frequency or frequency ranges generated by the engine in the exhaust.

The resonator housing and baffle may be constructed out of a suitable material such as steel, aluminum, a polymer, etc. Specifically, a multi-layer housing construction may be employed. For example, an insulator may be positioned between two metal layers to provide sound dampening. However in other examples, other constructions may be used such as a single layer metal housing.

Various characteristic of the resonator may be tuned to attenuate targeted frequencies. Specifically, the size (e.g., surface area spanning the openings) and geometry of openings 314 may be selected to enable dampening of a desired frequency of frequency range. It will be appreciated that the size of the openings may be selected to increase vehicle performance and driveability. Specifically, the size of the opening may be selected to increase the engine's low end torque as well as meet the desired acoustic characteristics within the exhaust system. The desired acoustic characteristics may include a sound tone and sound level produced by the exhaust system. Moreover, the size of the openings as well as other geometric characteristics of the resonator may be selected to reduce noise, vibration, and harshness (NVH) in the exhaust system. Various parameters such as vehicle weight, transmission gear ratios, final drive ratio, and valve timing may be taken into account when determining the size of the openings. In one embodiment the total cross-sectional area of the openings may be 0.88 inches$^2$. However, other cross-sectional areas may be used.

Moreover, the size (e.g., length and width) of the housing may also be selected to dampen a desired frequency or frequency range. Still further in some examples, the size, geometry, and/or spacing of the perforations included in the first and/or second exhaust conduits may be selected to dampen a desired frequency or frequency range.

It will be appreciated that the geometry (e.g., length, diameter) of the expansion chambers may be selected based the frequency or range of frequencies targeted for attenuation. The targeted frequencies may be determined by assessing a number of engine operating parameters such as fuel injection timing, valve timing, emission control system design (e.g., size, geometry, etc.), engine displacement, exhaust manifold design, etc.

FIG. 4 shows a cross-section of the resonator depicted in FIG. 3. The general flow pattern is depicted via arrows. It will be appreciated that the flow pattern is generally depicted for conceptual understanding and the flow pattern generated within the resonator has additional complexity which is not depicted. As shown exhaust gases may flow from the perforated portion of the first exhaust conduit Likewise exhaust gases may flow from the perforated portion of the second exhaust conduit into the second expansion chamber. Additionally exhaust gases may flow between the first and second expansion chambers. The size, number, and geometry of openings 314 in the baffle may be selected to control the mixing of the exhaust gases from the first and second exhaust conduits (210 and 212) into the resonator.

It will be appreciated that the systems and components in the figures are schematically depicted for purposes of illustration and clarity; and while FIGS. 3-4 are drawn approximately to scale, in other embodiments the actual dimensions and geometries may vary from those illustrated.

FIG. 5 shows a method 500 for operation of a dual-flow exhaust system. Method 500 may be implemented via the systems and components described above or alternatively may be implemented via other suitable systems and components.

First at 502 method 500 includes flowing exhaust gases from a first bank of engine cylinders into a first exhaust conduit. Next at 504 the method includes flowing exhaust gases from a second bank of engine cylinders into a second exhaust conduit.

Next at 506 the method includes flowing exhaust gases from the first exhaust conduit into a first expansion chamber of an enclosure defined by a resonator housing and a baffle spanning the resonator housing. Next at 508 the method includes flowing exhaust gases from the second exhaust conduit into a second expansion chamber in the enclosure.

In some examples, flowing exhaust gases from the first exhaust conduit includes flowing exhaust gases through a perforated portion of the first exhaust conduit enclosed by the housing, and flowing exhaust gases from the second exhaust conduit includes flowing exhaust gases through a perforated portion of the second exhaust conduit enclosed by the housing.

Next at 510 the method includes flowing exhaust gases between the first and the second expansion chambers through one or more openings in the baffle. In some examples the openings may be offset with respect to a lateral axis perpendicular to a central axis of the first or second exhaust conduits, as discussed above. At 512 the method includes flowing exhaust gases from the first and second exhaust conduits into the surrounding atmosphere downstream of the resonator.

The systems and methods described herein enable a single resonator to be used to attenuated targeted frequencies within a dual-flow exhaust system while decreasing the amount of back-pressure generated by the resonator when compared to other resonation devices used in dual flow exhaust systems including two separate housings. In this way, the acoustic characteristics of the exhaust system may be improved while reducing losses in the exhaust system, thereby increasing engine performance.

It will be appreciated that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various features, functions, acts, and/or properties disclosed herein, as well as any and all equivalents thereof.

The invention claimed is:

1. A resonator for a dual-flow exhaust system of an engine, the resonator comprising:

a housing defining an enclosure;

a baffle spanning the housing and separating a first and second expansion chamber of the enclosure, the baffle including at least one opening; and a first exhaust conduit and a second exhaust conduit extending through the baffle and housing, each conduit in fluidic communication with a separate cylinder bank and including a perforated portion positioned in separate expansion chambers and a non-perforated portion positioned in separate expansion chambers from the perforated portions, the at least one opening disposed between the first exhaust conduit and the second exhaust conduit.

2. The resonator of claim 1, wherein the baffle includes two or more openings.

3. The resonator of claim 2, wherein the two or more openings are offset with respect to a vertical axis spanning the baffle.

4. The resonator of claim 2, wherein the two or more openings are offset with respect to a lateral axis perpendicular to a central longitudinal axis of the first or second exhaust conduit.

5. The resonator of claim 1, wherein the first and the second exhaust conduits are parallel.

6. The resonator of claim 5, wherein the baffle is perpendicular to a central axis of the first and second exhaust conduits.

7. The resonator of claim 1, wherein perforations included in the perforated portion of the first exhaust conduit are different in at least one of size, spacing, and geometry than perforations included in the perforated portion of the second exhaust conduit.

8. A resonator for a dual-flow exhaust system of an engine, the resonator comprising:

a housing defining an enclosure;

a baffle separating a first expansion chamber and a second expansion chamber, the baffle having two or more openings fluidly coupling the first expansion chamber to the second expansion chamber;

a first exhaust conduit having an input coupled exclusively to a first cylinder bank extending through the baffle and the housing, the first exhaust conduit having a perforated portion through which exhaust gases flow from the first exhaust conduit into the first expansion chamber and a non-perforated portion positioned in the second expansion chamber; and a second exhaust conduit having an input coupled exclusively to a second cylinder bank, extending through the baffle and the housing, and including a perforated portion through which exhaust gases flow from the second exhaust conduit into the second expansion chamber and a non-perforated portion positioned in the first expansion chamber, the first and second exhaust conduits extending through the baffle and the housing being parallel, the two or more openings offset with respect to a lateral axis perpendicular to a central longitudinal axis of the first and second exhaust conduits, the lateral axis bisecting the first and second exhaust conduits.

9. The resonator of claim 8, wherein the baffle is perpendicular to a central axis of the first and second exhaust conduits.

10. The resonator of claim 8, wherein perforations included in the perforated portion of the first exhaust conduit are different in at least one of size, spacing, and geometry than perforations included in the perforated portion of the second exhaust conduit.

11. The resonator of claim 8, wherein the central axis of a cylinder in the first cylinder bank intersects a central axis of an opposing cylinder in the second cylinder bank at a non-straight angle.

12. The resonator of claim 1, wherein the at least one opening is positioned a first distance from a first lateral wall of the housing, the first exhaust conduit is positioned a second distance from the first lateral wall of the housing, and the second exhaust conduit is positioned a third distance from the first lateral wall of the housing, the first distance less than the second distance, the third distance greater than the second distance.

13. The resonator of claim 8, wherein the two or more openings are disposed between the first and the second exhaust conduits.

14. A dual-flow engine exhaust resonator, comprising: a housing defining an inside enclosure through which a first exhaust conduit and a second exhaust conduit extend longitudinally; a baffle with vertically aligned openings positioned laterally between the conduits, the baffle spanning the housing perpendicular to the conduits and separating first and second expansion chambers, each conduit extending through the baffle including asymmetrically-positioned perforations in mutually-exclusive expansion chambers, each conduit in fluidic communication with a separate cylinder bank; wherein the asymmetrically-positioned perforations of the first exhaust conduit are in fluid communication with only the first expansion chamber and the asymmetrical perforations of the second exhaust conduit are in fluid communication only with the second expansion chamber, the first and the second expansion chambers in fluid communication via the vertically aligned openings.

* * * * *